US005232231A

United States Patent [19]

Carlsmith

[11] Patent Number: 5,232,231

[45] Date of Patent: Aug. 3, 1993

[54] BRAKE FOR ROLLER SKATES

[76] Inventor: Bruce Carlsmith, Box 965, Middletown, Calif. 95461

[21] Appl. No.: 928,295

[22] Filed: Aug. 12, 1992

[51] Int. Cl.[5] ..... A63C 17/14; A63C 17/06

[52] U.S. Cl. ..... 280/11.2; 280/11.22; 280/11.3

[58] Field of Search ..... 280/11.2, 11.21, 11.22, 280/11.27, 11.3, 842, 87.041, 87.042; 188/29, 74

[56] References Cited

U.S. PATENT DOCUMENTS

| | | | |
|---|---|---|---|
| 1,974,152 | 9/1934 | Draws | 280/11.2 |
| 2,097,721 | 11/1937 | Cledina | 280/11.2 |
| 2,173,716 | 9/1939 | Gurleay | 280/11.2 |
| 2,865,645 | 12/1958 | Levin | 280/11.2 |
| 2,872,201 | 2/1959 | Wagers | 280/11.2 |
| 2,998,260 | 8/1961 | Meyer | 280/11.3 X |
| 3,112,119 | 11/1963 | Sweet | 280/11.2 |
| 3,224,785 | 12/1965 | Stevenson | 280/11.2 |
| 3,484,116 | 12/1969 | Allen | 280/11.21 |
| 3,580,595 | 5/1971 | Ware | 280/11.2 |
| 3,734,244 | 5/1973 | Roddy | 188/83 |
| 3,767,220 | 10/1973 | Peterson | 280/11.2 |
| 3,900,203 | 8/1975 | Kukulowicz | 280/11.2 |
| 4,033,596 | 7/1977 | Andorsen et al. | 280/11.2 |
| 4,061,348 | 12/1977 | Carter | 280/11.21 |
| 4,275,895 | 6/1981 | Edwards | 280/11.2 |
| 4,295,547 | 10/1981 | Dungan | 188/2 R |
| 4,298,209 | 11/1981 | Peters | 280/11.2 |
| 4,300,781 | 11/1981 | Riggs | 280/11.2 |
| 4,319,759 | 3/1982 | Neitz | 280/11.2 |
| 4,394,028 | 7/1983 | Wheelwright | 280/11.19 |
| 4,417,737 | 11/1983 | Suroff | 280/11.12 |
| 4,453,726 | 6/1984 | Ziegler | 280/11.2 |
| 4,691,931 | 9/1987 | Vincent | 280/11.12 |
| 4,805,936 | 2/1989 | Krantz | 280/842 |
| 4,807,893 | 2/1989 | Huang | 280/11.2 |
| 4,817,974 | 4/1989 | Bergeron | 280/11.2 |
| 4,911,456 | 3/1990 | Sarazen | 280/11.2 |
| 4,943,072 | 7/1990 | Henig | 280/112 |
| 4,943,075 | 7/1990 | Gates | 280/842 |
| 5,029,882 | 7/1991 | Marandel | 280/11.2 |
| 5,052,701 | 10/1991 | Olson | 280/11.2 |
| 5,067,736 | 11/1991 | Olson | 280/11.2 |
| 5,088,748 | 2/1992 | Koselka et al. | 280/11.2 |
| 5,143,387 | 9/1992 | Colla | 280/11.22 X |

FOREIGN PATENT DOCUMENTS

| | | | |
|---|---|---|---|
| 2651963 | 5/1978 | Fed. Rep. of Germany | 280/11.21 |
| 2593713 | 8/1987 | France | 280/11.2 |
| 11117 | 4/1910 | United Kingdom | 280/11.2 |
| 609453 | 9/1948 | United Kingdom | 280/11.21 |
| 8201828 | 6/1982 | World Int. Prop. O. | 280/11.2 |

*Primary Examiner*—Brian Johnson

*Attorney, Agent, or Firm*—George W. Wasson

[57] ABSTRACT

A brake for roller skates comprising a simple, lightweight mechanism which multiplies the force exerted by the skater into a substantial braking force. The force is exerted by the skater by pushing downward with the heel, which rotates the boot with respect to the frame of the skate. That force is transmitted with leverage to braking shoes or pads that impinge on brake drums adjacent to the wheels. Adjustment for brake wear is provided by a screw that compensates for the shortening of the brake shoe as normal wear occurs. A detent mechanism locks the boot and frame together during normal skating.

7 Claims, 6 Drawing Sheets

Prior Art

BRAKE FOR ROLLER SKATES

BACKGROUND: FIELD OF INVENTION

This invention relates to roller skates, and particularly to brakes for roller skates.

BACKGROUND: DESCRIPTION OF PRIOR ART

This invention relates to roller skates of either the in-line type or the more traditional adjacent-wheel type. The invention consists of an effective, adjustable braking mechanism.

Roller skates have been popular recreational devices but have always suffered from inadequate brakes. Inventors have repeatedly described how beginners have trouble learning to skate due to the free running nature of roller skates, and how even experienced skaters have difficulty avoiding unexpected obstacles.

Continuous Brakes

Numerous solutions to this problem have been advanced. For beginners, a frequently proposed solution has been to add a device that exerts a constant rolling resistance to the skate. This approach was advocated by Levin in U.S. Pat. No. 2,865,645 in 1958. He envisioned a spring and nut mounted on the rear axis of the skate with which one could adjust the pressure and therefore the drag on the rear wheel bearings. Roddy in U.S. Pat. No. 3,734,244 in 1973 produced the same affect by putting a drum brake directly on the wheel. Kukulowicz in 1975 in U.S. Pat. No. 3,900,203 introduced a single thumbwheel that bears onto a single plate that bears on two adjacent, tandem wheels. Wheelwright in 1983 in U.S. Pat. No. 4,394,028 described a design where a wheel was attached to the rear of the skate at a level slightly above that of the usual wheel, such that its rolling surface touches the ground only when the skater rocks the skate slightly backward. An adjustable friction device allows the user to set the amount of rolling resistance, but, with Levin's and Roddy's, the skater can do so only while at rest. All of these approaches do not allow intermittent application of the brake, and therefore do not address the general problem of obstacles and the desire of most skaters to safely achieve maximum speed with minimum effort.

Many patents on skate brakes have been issued to solve this general problem and have principally taken one of three forms: dragging the toe, pulling on a rope or cable, and pressing on the heel. These three motions reflect the three kinds of action or motion available to the skater to actuate any sort of braking mechanism.

Toe Stops

Dragging the toe is typically accomplished with the use of a pad made of rubber or other material attached to a stud that protrudes down and forward from the toe of the skate. This approach is illustrated in FIG. 1. Many minor refinements have been disclosed, including for example Ware with U.S. Pat. No. 3,580,595 in 1971 which disclosed a method of attaching a toe stop to an inexpensive street skate, and Neitz in U.S. Pat. No. 4,319,759, which added a pin to the toe stop to prevent rotation of the pad. Toe pads are so simple they were often added to patents as an assumed part of the skate, as in U.S. Pat. No. 4,817,974 in 1989 by Bergeron and U.S. Pat. No. 4,298,209 in 1981 by Peters. The primary drawback of the toe pad has been its limited effectiveness, since the weight a skater can apply to the toe of a skate that is extended behind him or her is limited, and therefore the braking force generated is also limited.

Cables

Cables can actuate braking mechanisms in a variety of ways since the cable or rope can be designed to pull in many different directions. Dungan in 1981 disclosed in U.S. Pat. No. 4,295,547 a hydraulic version for small vehicles; Riggs in U.S. Pat. No. 4,300,781 the same year disclosed a version with a cable and brake pads; Krantz in 1989 disclosed a version for wheeled skis in U.S. Pat. No. 4,805,936, and Gates disclosed another version in U.S. Pat. No. 4,943,075 in 1990. None of the various types have been used extensively, however, primarily because holding a rope or cable while skating is distracting and uncomfortable, and skaters need their hands free to assist themselves in balancing.

Heel Pad

Brakes actuated by heel pressure have been the most widely disclosed kind of braking mechanism. The actuating motion typically consists of either rotation around the rearmost wheel or rotation around a hinge built into the skate. The braking force has been generated by either dragging a pad or auxiliary braking wheel on the surface of the ground, or by actuating a mechanism which engages a brake on one or more of the wheels or rollers of the skate. The brake mechanism itself has been such types as shoe, band, and disc. However, the simple heel pad has been by far the most popular of all these brake types.

With a heel pad, the skater brakes by advancing one foot forward, bringing the pad into contact with the ground, and modulating his or her weight between the freely rotating skate and the braking skate. The use of this brake is illustrated in FIG. 2.

Advances in heel pads have been largely in the area of construction. Wagers in U.S. Pat. No. 2,872,201 in 1959 taught a refined method of attaching the pad to the structure of the skate. Sweet in several unusual arrangements in U.S. Pat. No. 3,112,119 in 1963 drops the heel pad in favor of the heel of the shoe itself, or a pad directly under the heel as part of the main plate of the skate. Suroff in U.S. Pat. No. 4,417,737 in 1983 does something very similar in connection with a ratchet-driven self-propelled device. And finally Olson in U.S. Pat. Nos. 5,052,701 and 5,067,736, both in 1991, further refines the heel pad technology using plastic webs and a wear indicator.

The basic heel pad has been widely used on both in-line skates and on the traditional roller skates, but it suffers from several key weaknesses. The first arises from the geometry of the brake pad and the rearmost wheel. As the skater pushes down on the heel of the skate, his or her weight tends to be supported primarily on the freely rolling wheel, and not on the brake pad. Weight on the wheel generates no braking force. The brake pad's position behind the heel means that to bring the pad to bear, the skater must rotate his or her skate in a motion that can be visualized by raising one's toes into the air while keeping one's heel on the ground. This is an unnatural motion for the foot, because it is not required in walking, running, or other routine activity. Consequently the muscles in the foot called upon to brake the skate are not strongly developed, and the skater finds it difficult to put much pressure on the brake pad.

Furthermore, the ability of the skater to keep his or her balance depends on their being able to put weight on at least three points on the ground. At rest, this is normally done automatically by having weight on both the heel and toe of both feet. This stance provides four points, and balance is maintained by modulating the distribution of force between the ball and the heel of the foot. Skates remove the friction in the forward/backward direction, making balance that much more difficult, but the principle of three points still governs the skater's ability to remain upright.

When a skater attempts to brake using a rear pad, he or she must put a substantial fraction of their weight on the braking skate. To do so they must transfer more and more of their weight from the foot that provides two points of contact (heel and toe) to the foot that provides only one (the heel). Thus the more they brake, the more difficulty they have maintaining their balance. In addition, they are required to put their weight on the brake pad in a fashion that is unnatural and difficult, as already described.

Finally, the heel pad shares the weight of the skater with one or more free-wheeling wheels. This arrangement robs the pad of much of its potential effectiveness, since the amount of braking force is proportional to the weight applied.

In summary, the heel pad has two severe disadvantages. First, the skater cannot easily apply much force to the brake, due to the awkward position of the pad and the presence of a free-wheeling wheel. Second, use of the brake reduces the stability of the skater. The practical result is that no one except the most experienced skaters are effectively able to stop themselves in an emergency using the heel pad, and consequently most skaters skate in flat, open areas where quick stops are not required.

The above discussion helps describe why the effectiveness of any skate brake is a combination of two conditions: the amount of energy required of the skater to generate sufficient braking force, and the ease with which that energy is applied. Hand-held devices, for example, may require very little energy, but are inconvenient to use. Any device that requires the skater to give up some of his or her stability subtracts from the skate's effectiveness. And of course, the brake must be reasonably simple and inexpensive to produce.

One can easily discover the combination of features that will meet the above conditions by visualizing the series of events that must occur to brake a skate. First, the skater must apply energy. As shown above, rotation of the skate around the rear wheel is an unnatural movement for the foot. It is much better to be able to push down directly on the heel, which implies an axis somewhere ahead of the heel. The heel pad uses an axis behind the heel.

Secondly, a superior brake will multiply the applied force in some fashion with leverage. This will reduce the amount of force required from the skater. The less force that is required from the skater, the easier the brake will be to use, because the skater needs as much spatial and muscular freedom as possible to remain upright.

Thirdly, the braking force should be applied to all the wheels of the skate. Any design that allows a freely rolling wheel when brakes are being applied again subtracts from the effectiveness of the overall design.

Finally the skate should not have to be rotated such that only one wheel contacts the ground. This robs the skater of some of his or her balance. It also makes steering more difficult, particularly if a pad is brought into contact with the ground, since a pad has no directional preference like a wheel always does.

Rear Axis Brake Mechanisms

A wide variety of alternate braking mechanisms have been proposed in an effort to overcome the disadvantages of the heel pad brake. Most of them use heel rotation around a "rear" axis below or behind the heel, and consequently don't allow the skater to apply much braking force while making it difficult to steer. Examples include:

Draws in U.S. Pat. No. 1,974,152 in 1934 disclosed a design where rotation of the skate around it's rearmost wheel pushed an auxiliary wheel into contact with the ground. The auxiliary wheel then pulls a band brake around a drum coaxial with the rear wheel. Aside from the inherent disadvantages of a rear axis design, band brakes often don't fully disengage.

Ziegler in 1984 in U.S. Pat. No. 4,453,726 described a similar design that uses an auxiliary roller which, when pushed upward by the rotation of the skate around it's rear wheels, pushed up a conical plunger. The plunger's conical surface contacts and pushes two sliding elements parallel to the wheel axis and against the inside of brake discs mounted on the inside of the two rear wheels. The sliding action will have great friction, however.

Sarazen in U.S. Pat. No. 4,911,456 in 1990 disclosed a device where two paddles are forced against the rolling surface of rear wheels when the skate is rotated backward. His design uses a thick rubber disc as the hinge mechanism, located at the rear of the skate as part of a "5th wheel" assembly. The skater is forced to use additional force to deform the disc.

Marandel in U.S. Pat. No. 5,029,882 in 1991 described a plate which when pushed by a toe pad of the other skate in turn rubs the rear wheel or wheels of the skate, slowing it. The device has limited effectiveness, brakes only one wheel, and forces the skater to perform a difficult balancing feat while braking.

Finally Koselka et al. in U.S. Pat. No. 5,088,748 in 1992 disclosed a rear mounted auxiliary wheel with a brake whose action becomes more severe as increased pressure is mounted by skate rotation. This device resembles the heel pad in that its braking action is progressive, and at the moment when the braking wheel locks up, it is conceptually equivalent to the heel pad. Like the heel pad, it leaves one wheel unbraked, limiting the design's effectiveness.

Leverage

A few designs that explicitly make use of leverage have been disclosed. None of them possess all the other elements of an effective roller skate brake. Examples include:

Peterson in 1973 in U.S. Pat. No. 3,767,220 disclosed a device that uses a cuff around the skater's lower leg that incorporates a drum brake that bears directly on the roller of the skate. The design requires very large wheels so the leg's calf can touch the wheel, and the leverage is minimal. The braking motion required, leaning backward using the ankle as a pivot, is awkward, tending to throw the skater off balance.

A similar design was disclosed by Andorsen et al. in U.S. Pat. No. 4,033,596 in 1977. They described a brake for roller skis that utilizes a lever pushed by the calf on the skier's leg which has a braking arm attached to its lower extremity. Braking arm in turn bears on the surface of the rear roller wheels. A major drawback is the need for a long and somewhat awkward arm, a design not well suited to use by skates. As in Peterson's design, the braking motion is awkward.

Yet another variation was disclosed by Edwards in 1981 in U.S. Pat. No. 4,275,895. His device substituted a brake drum for the simple beam of Andorsen's device, but still requires a long arm.

Forward Axis

A few designs do incorporate an axis ahead of the heel, but again, none furnish all the other requisites of an effective brake. Examples include:

In 1937 Cledina in U.S. Pat. No. 2,097,721 disclosed a device that included a band type brake actuated by pressure applied to the heel of the skate. It brakes only one wheel and its band brake may never fully disengage.

Gurleay in 1939 in U.S. Pat. No. 2,173,716 disclosed a drum brake design. He requires the skater to overcome the resistance of a spring in order to allow braking. The front wheels remain on the ground and are not braked.

In 1977 Carter disclosed in U.S. Pat. No. 4,061,348 a disc brake design where downward heel pressure is translated into lateral pressure via a pivoting mechanism, which in turn exerts force on the face of two discs, each mounted to one of the two rear wheels. The linkages don't offer much leverage, their sliding contacts have a lot of friction, and the pivot design allows the heel to initiate braking at any time. To compensate for that, springs are included that hold up the weight of the skater's heel. They then also resist the braking action.

Huang in a different approach in U.S. Pat. No. 4,807,893, dated 1989, combines a heel pad with a small brake drum. His design only brakes in one wheel, and involves tilting the skate on its rearmost wheel.

Other

A few other unique designs also exist in the prior art. In 1965 Stevenson in U.S. Pat. No. 3,224,785 proposed a braking roller that encounters friction simultaneously from the ground and on the main roller, or in an alternative embodiment, uses a fluid filled bladder and knee bending to actuate a piston onto the side of the main roller. The first alternative will likely be very sensitive to lock up and requires an awkward rotating and pressing motion, the second is cumbersome to wear and subject to fluid leakage. Both alternatives brake only one wheel.

In 1992 Colla was awarded U.S. Pat. No. 5,143,387 for his brake. He proposes connecting several brake pads with an connecting rod but proposes to actuate the brake with a curling action of the skater's toes, which does not provide any leveraging means to drive the brake assembly.

Pezet in 1987 disclosed in French patent number 86 01568 a brake for a roller ski. It utilizes a single brake on the rear wheel and lacks leverage.

In 1978 Vincent in U.S. Pat. No. 4,691,931 and related patents disclosed a walking device which incorporates a drum brake. The brake is not easily modulated, however, and the device itself is very complicated to manufacture.

Finally Henig in U.S. Pat. No. 4,943,072 in 1990 disclosed a design that relies on bringing the two skates together, engaging two rows of opposing teeth (one row on each skate), and sliding the two skates relative to one another. This method puts a great constraint on the skater and is not amenable to applying much force to the braking mechanism.

None of these designs incorporate all the elements necessary for a truly practical brake: an axis forward of the heel, leverage to multiply the exerted force into the braking force, braking force on all wheels, and retention of all wheels on the ground. Consequently none of these designs have brought sufficient advantages over the heel pad brake, which has remained the most popular.

OBJECTS AND ADVANTAGES

Accordingly, several objects and advantages of my invention are:

(a) to provide a roller skate with a brake that allows the skater to apply sufficient force to the brake mechanism with little frictional loss (b) to provide a roller skate which multiplies the applied force to result in greater braking force (c) to provide a roller skate with a brake that can be easily adjusted for wear (d) to provide a roller skate which brakes all rolling wheels, and which may be braked without rotating its forward wheels off the ground Further objects and advantages of my invention will become apparent from consideration of the drawings and ensuing description.

SUMMARY OF THE INVENTION

An improved brake for in-line or traditional roller skates that allows effective slowing and stopping of the skater with less effort, more control, and fewer of the balance problems of earlier designs.

The improved design utilizes a boot and a frame to which are attached a plurality of wheels located to rotate in a vertical plane. The frame consists of two side walls, a top surface parallel to the ground with multiple openings, and several webs connecting the two side walls. The side walls also incorporate stiffening material for structural rigidity. Seen in profile, the walls each include a crest rearward of the center.

The boot is attached to the frame via a hinge somewhat to the rear of the middle of the foot, allowing the boot to rock with respect to the frame. The hinge consists of a shaft that runs through an aperture in the first crest, through apertures in two or more flanges molded into the underside of the boot, and through an aperture in the second crest.

A rod threaded on one end is attached to the heel of the boot via an additional hinge. The shaft of the hinge is formed from two coaxial pins that each pass through an aperture in a flange that protrudes down from the heel area of the boot. They then enter an aperture in a small block that sits between those flanges. The placement of the two pins is symmetrical, such that the block can swing freely on the two pins.

The threaded rod is inserted into an aperture in the block that is perpendicular to the apertures that retain the hinge pins. The threaded rod includes a step down in diameter such that the reduced diameter is just slightly under the diameter of the aperture in the block. The threaded rod also includes an annular slot into which a retaining ring is inserted. Thus the threaded rod is retained in the block by the step in diameter on one end and the retaining ring on the other.

The reduced diameter of the threaded rod protrudes through the block and through a second aperture located at the rearmost part of the boot flange. This aperture is larger than the diameter of the push rod, allowing the block and threaded rod to pivot together without interfering with the flange. This end of the threaded rod is terminated with a thumbscrew.

The threaded end of the threaded rod is threaded into a push rod. The push rod and the threaded rod are coaxial. The other end of the push rod is affixed with a pin to an actuating rod that lies within the frame, parallel to the ground and with the boot's toe-heel axis. The actuating rod is attached to one or more brake pad assemblies with additional pins, also parallel to the ground and at right angles to the axis of the boot. The brake pad assemblies consist of a housing in the shape of a small rectangular block, and a brake pad of high friction, heat resistant material. Each brake pad assembly is attached to the frame via a shaft that runs through apertures in the side walls that confront one another and through an aperture in each of the brake pad mounts, located on the opposite end of the mount from where the actuating rod is attached.

A torsion spring surrounds the shaft of the main hinge. The spring's two arms push against the bottom of the boot and against the top surface of the frame, respectively.

A tapered plunger of closely controlled diameter is attached to the boot, near the toe and projecting downward. The plunger incorporates a circumferential groove at the end opposite the boot.

In the frame, the most forward web connecting the two side walls does not quite come to the top of the sidewalls, and includes a channel and a tapered aperture directly opposite the plunger. Into the space defined by the sidewalls, the foremost web, and the plane of the frame's top edges, lies a plate which is held to the web by two or more screws.

In the channel in the top of the foremost web lies a clip consisting of spring steel or similar material bent to form two arms parallel to one another. These arms possess bends that together form a ring slightly smaller than the groove of the plunger. This clip is retained in place by the plate.

Each of the substantially similar wheels consists of a hub made of aluminum or other lightweight material which is encapsulated by a tire made of urethane or similar material, as in current designs. Each hub contains a hole in its center which contains bearings, and incorporates a drum of diameter somewhat less than that of the tire. The hub is shaped with an irregular cross-section which serves to retain the tire. The tire encapsulates the entire hub except the drum.

The brake described here possesses a number of advantages over the prior art. Compared to the designs described above and the simple heel pad it offers significantly enhanced braking action by virtue of the leverage in the linkage mechanism, the kinematics of which are further described below. It is simple, possessing few parts that complicate manufacturing and assembly. It provides braking action though the existing wheels, rather than adding additional braking wheels which in turn add weight and cost. The braking surface is not the same as the rolling surface, so wear on the rolling surface is minimized. It allows adjustment to compensate for brake wear.

Figure 1:
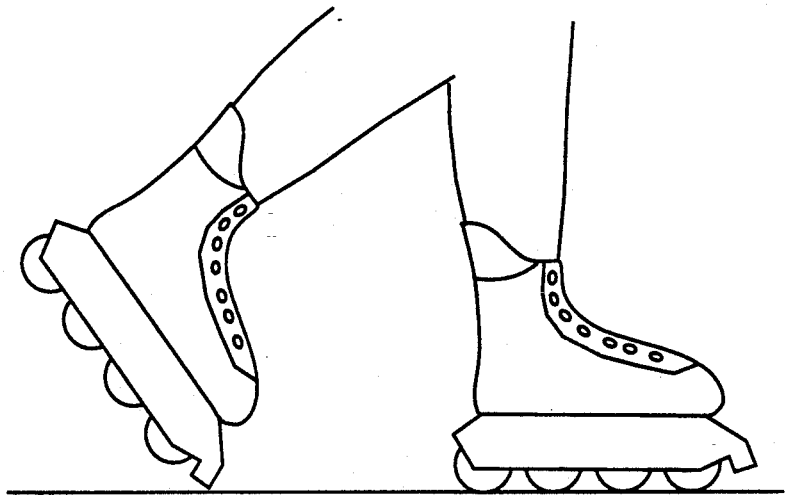
Fig. 1 Prior Art
FIG. 1 shows a prior art toe drag brake for a roller skate.
Figure 2:
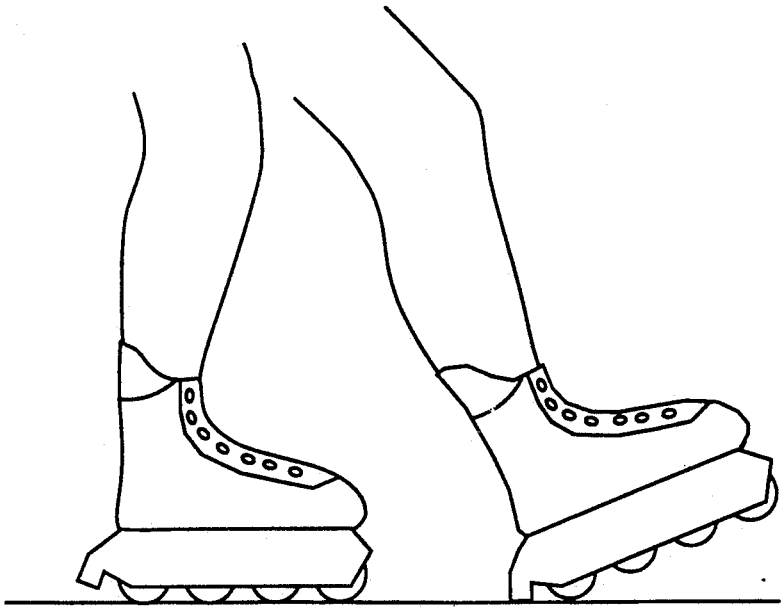
FIG. 2 shows a prior art heel drag brake for a roller skate.
Figure 3:
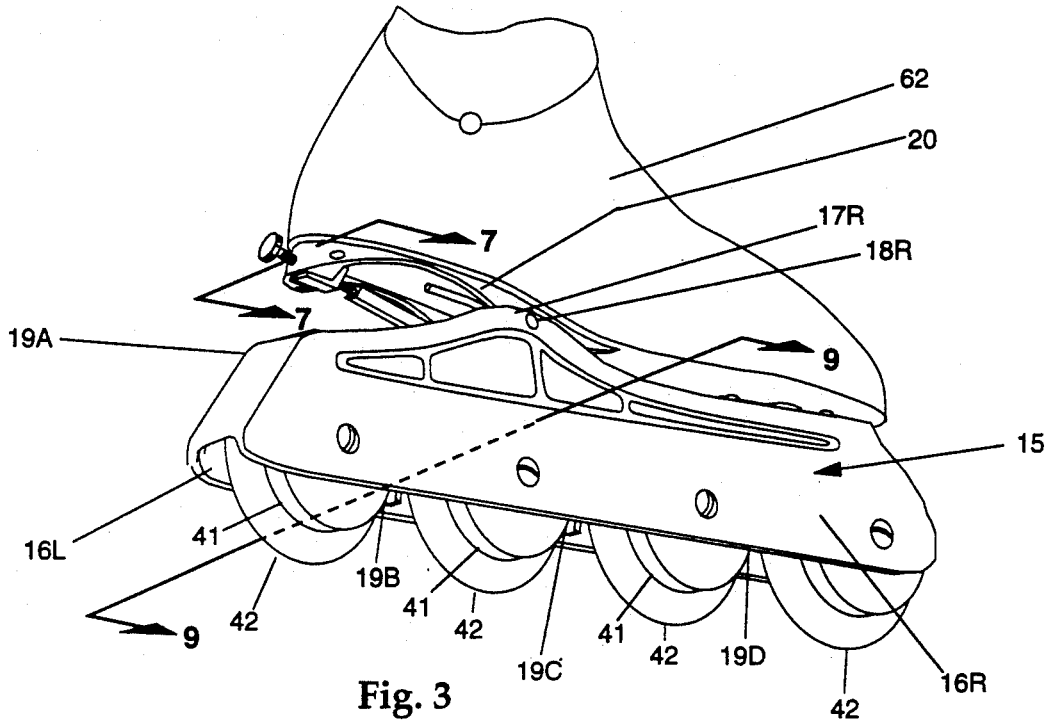
FIG. 3 is a perspective view of the present invention.

| PARTS LIST AND DESIGNATORS | |
|---|---|
| 11 | Not used |
| 12 | Pin |
| 13 | Threaded rod |
| 14 | Thumbwheel |
| 15 | Frame |
| 16 | Side walls |
| 17 | Frame flange |
| 18 | Aperture |
| 19 | Web |
| 20 | Boot flange |
| 21 | Aperture |
| 22 | Spring |
| 23 | Shaft |
| 24 | Push rod |
| 25 | Groove |
| 26 | Pin (push rod to actuating rod) |
| 27 | Aperture (clearance hole for threaded rod) |
| 28 | Shoulder |
| 29 | Retaining ring |
| 30 | Brake pads |
| 31 | Aperture (bottom of brake mounts) |
| 32 | Brake mounts |
| 33 | Pins (bottom of brake assembly) |
| 34 | Pins (top of brake assembly) |
| 35 | Actuating rod |
| 36 | Cam |
| 37 | Cam follower |
| 38 | Dog |
| 39 | Dog follower |
| 40 | Screws |
| 41 | Brake drums |
| 42 | Tires |
| 43 | Not used |
| 44 | Threaded aperture |
| 45 | Not used |
| 46 | Plunger |
| 47 | Tapered aperture (in plate) |
| 48 | Plate |
| 49 | Tapered aperture (in web 19D) |
| 50 | Bushing |
| 51 | Groove |
| 52 | Clip |
| 53 | Arm (rear) |

-continued

| PARTS LIST AND DESIGNATORS | |
|---|---|
| 54 | Arm (forward) |
| 55 | Channel |
| 56 | Exterior surface (of plunger) |
| 57 | Interior surface (of aperture) |
| 58 | Not used |
| 59 | Not used |
| 60 | Not used |
| 61 | Detent assembly |
| 62 | Boot |
| 63 | Block |
| 64 | Aperture |
| 65 | Not used |
| 66 | Not used |
| 67 | Not used |
| 68 | Not used |
| 69 | Not used |
| 70 | Not used |

DESCRIPTION OF THE PREFERRED EMBODIMENT

Referring to FIGS. 3, 4, 6, 9, and 11, the invention includes a foot supporting means or boot 62 which encloses the foot of the skater with buckles, laces, or other suitable means (not shown), and a frame 15, made of glass reinforced nylon or similar material. The frame consists of two side walls 16L and 16R which include two broad frame flanges 17L and 17R extending upward and generally parallel or coplanar with the side walls 16L and 16R. Two coaxial apertures 18L and 18R extend through the frame flanges 17. The frame also includes webs 19A–19D which span and connect the side walls 16L and 16R and provide rigidity to the frame.

The boot 62 and the frame 15 are primarily connected with a hinge formed by the boot flanges 20L and 20R attached by suitable means to the sole of the boot and at each side of the sole, apertures 21L and 21R, surrounded by frame flanges 17L and 17R and apertures 18L and 18R. A shaft 23 connects the segments of the frame 15 and boot flange 20 of the boot, allowing the boot to rock with respect to the frame.

Figure 7:
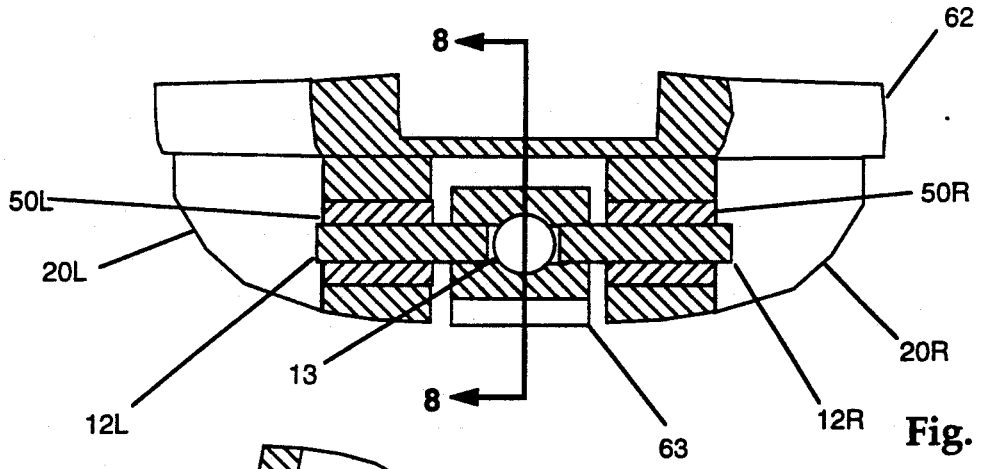
FIG. 7 is a partial section of the rear hinge assembly from the rear and along the lines 7—7 of FIG. 3.
Figure 8:
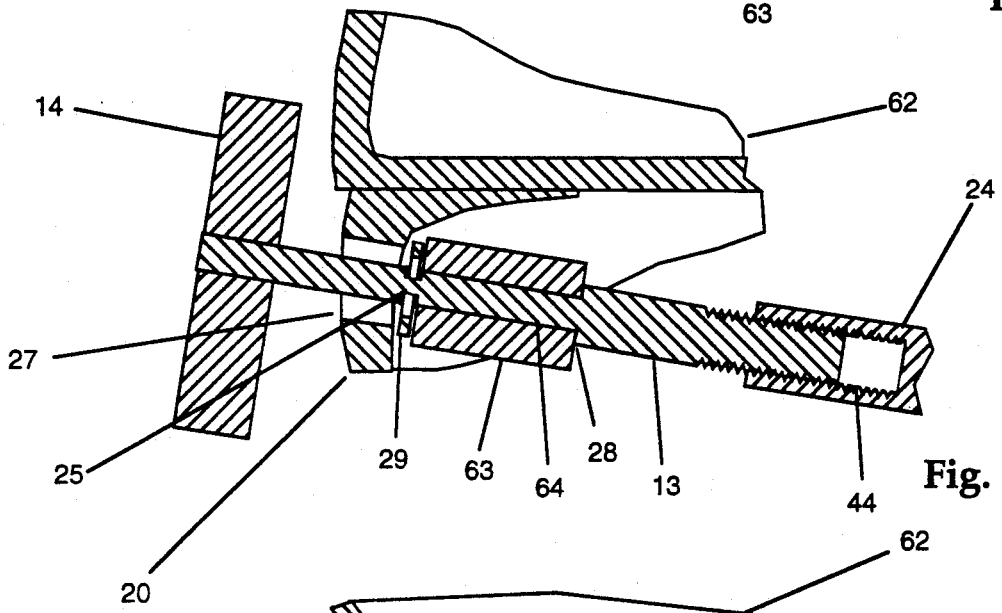
FIG. 8 is a partial section of the rear hinge assembly from the side and along the lines 8—8 of FIG. 7.
Figure 9:
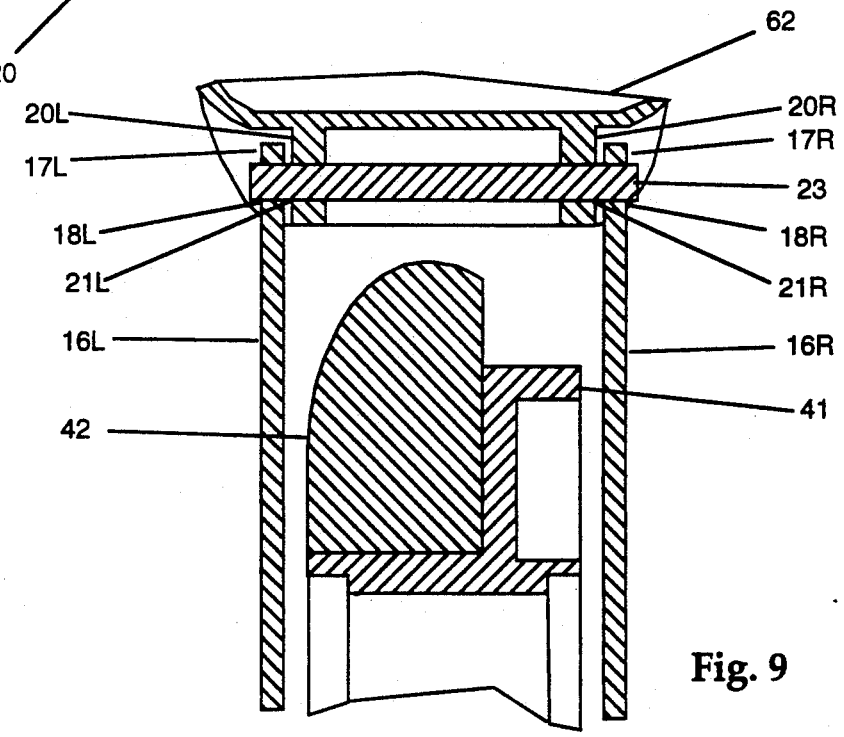
FIG. 9 is a partial section of the boot hinge assembly from the rear along the lines 9—9 of FIG. 3.

The boot flange 20 also provides the external part of a second hinge near the heel of the boot 62. As shown in FIGS. 7 and 8, pins 12L and 12R sit inside the boot flange 20, held by bushings 50L and 50R, and engage block 63, which contains an aperture 64 through which threaded rod 13 is inserted. Threaded rod 13 has a shoulder 28 that sits adjacent to the inside surface of block 63. The threaded rod 13 also includes a groove 25. A retaining ring 29 is inserted into the groove 25. The combination of the retaining ring 29 and the shoulder 28 serves to retain the threaded rod 13 with respect to the block 63.

Figure 4:
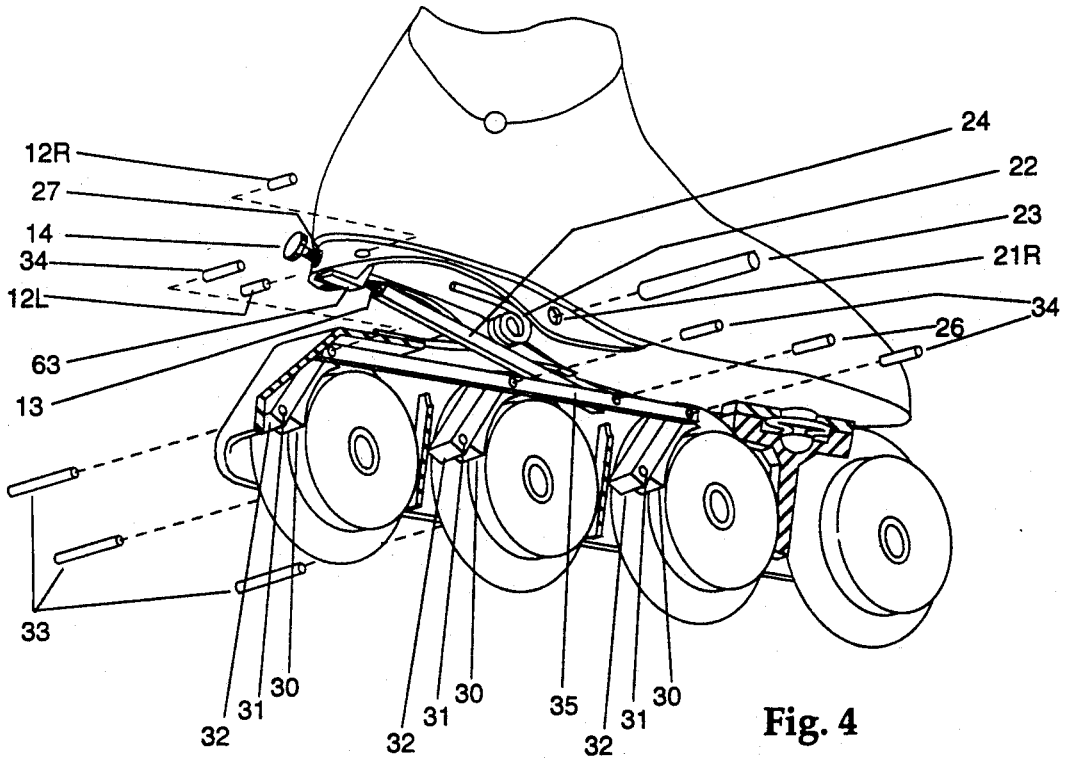
FIG. 4 is an exploded and partial sectional perspective view of the present invention.
Figure 11:
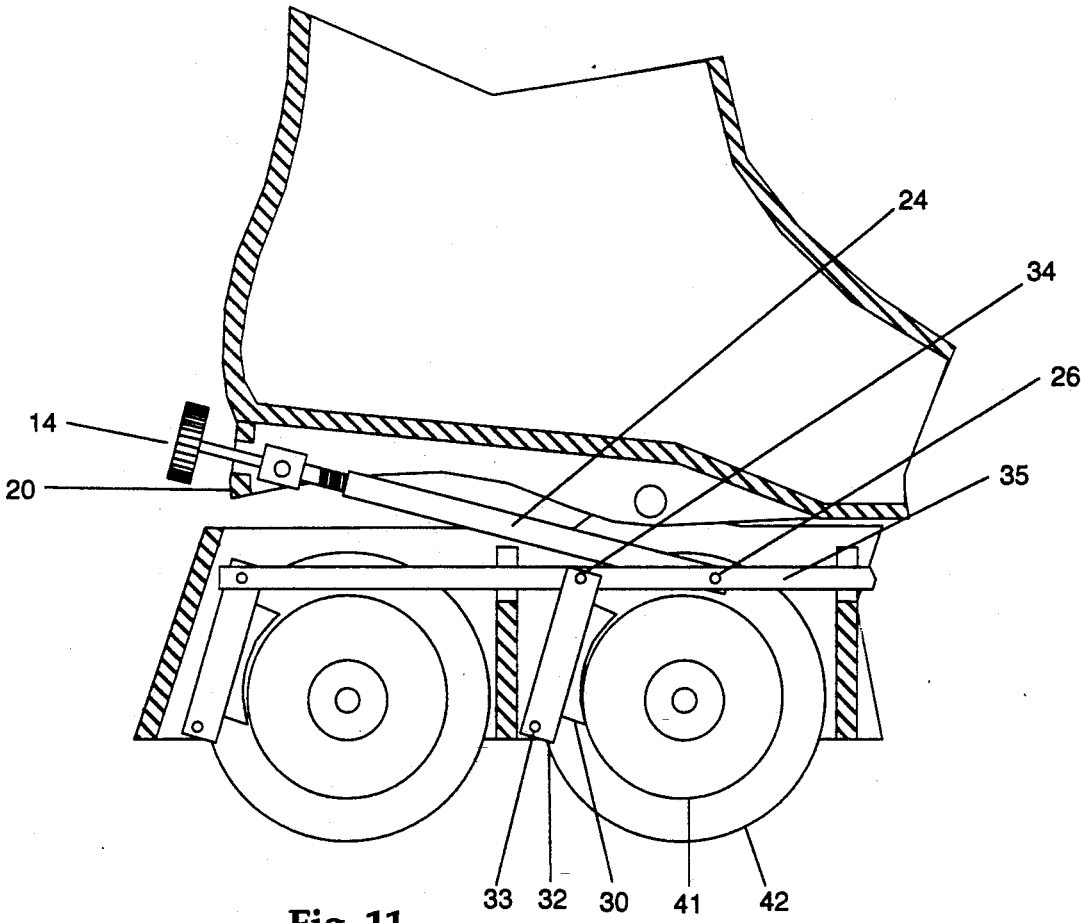
FIG. 11 is a perspective view partially in section of an actuating linkage of the present invention.

As shown in FIGS. 4, 8, and 11, the threaded end of the threaded rod 13 is screwed into the threaded aperture 44 of push rod 24. The other end of push rod 24 is attached to the actuating rod 35 with a pin 26. Actuating rod 35 is a means movable with respect to the frame and push rod 24 is a connecting means between the boot 62 and the actuating rod 35. Thus turning thumbwheel 14, which is firmly affixed to threaded rod 13, causes push rod 24 to move toward or away from block 63. And, as will be seen hereinafter, any wear on the brake shoes may easily be compensated for by movement of the rod and with it the brake pads or shoes.

A spring 22 is wrapped around the shaft 23 and has two free arms. One of the two arms of spring 22 rests against the underside of boot 62 and the other free arm rests against the top of frame 15, respectively. The wrapping of the spring 22 around the shaft 23 puts the spring 22 under torsion at all times, and thus the arm against the boot 62 tends to push boot 62 in a clockwise direction as viewed in FIG. 4, or to a toe-down position.

Braking action with the assembly of the present invention is accomplished when the skater pushes down with his or her heel on the boot 62. The boot 62 rotates on the hinge formed by the boot 62 and the frame 15 already described and pushes block 63 downward, toward the frame 15 carrying with it threaded rod 13 and push rod 24. At its other end, push rod 24 rotates around pin 26. Because pin 26 is spatially in a different location than the shaft 23, push rod 24 rotates slightly with respect to boot 62. This rotation is freely allowed by the hinge composed of block 63, flange 20, and pins 12L and 12R. Aperture 27 is larger than threaded rod 13, allowing threaded rod 13 to rotate freely with block 63 on pins 12.

Figure 10:
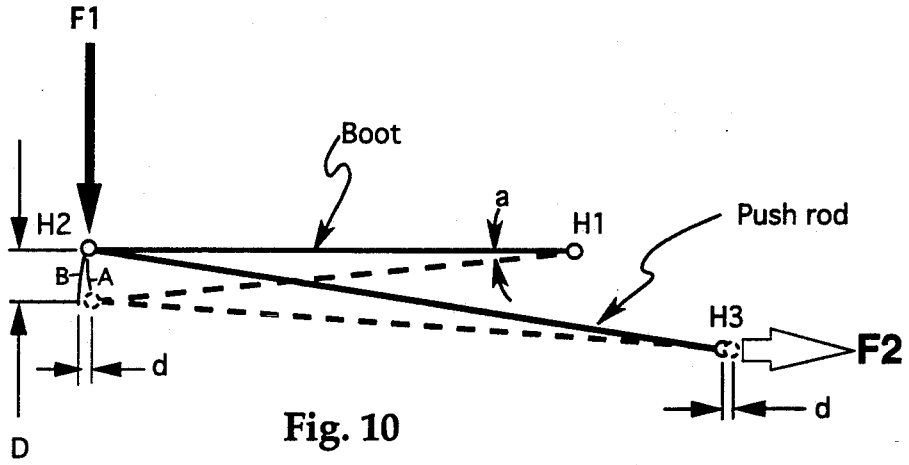
FIG. 10 is a diagrammatic illustration of how the preferred embodiment of the present invention develops braking leverage.

It has been noted that leverage is a key feature of the invention, as it multiplies a small force exerted by the heel of boot 62 to result in a large force exerted on brake surface or drums 41. Referring to the diagrammatic illustration of FIG. 10, when the skater pushes down with force F1 on the heel of the skate, the boot rotates around hinge H1 and the heel of the skate moves through an arc depicted by both angle "a" and arc "A"; arc A has a vertical component D. The push rod 24 rotates around hinge H3 and would, if not constrained rotate through arc B; arc B an arc that originates at the same point as arc A but terminates at some small horizontal distance d away from arc A. However, the left end of push rod 24 is also attached to hinge H2 and therefore also is constrained to move through arc A. Because push rod 24 is of fixed length, its right end, being allowed to move only in the horizontal direction by virtue of being attached to actuating rod 35, is also forced to move to the right distance d. The angle between the two arcs A and B is also a, and therefore the distance d for small angles "a" is approximately given by the expression $d = \text{"a"} \times D$ where the angle a is expressed in radians. The force F2 exerted on the push rod 24 and transferred to the brake pads is given by the expression $F2 = (D/d) \times F1$, and is much larger than the force F1 exerted on the heel of the boot since D is much greater than d.

Referring again to FIGS. 4 and 11, because of the kinematics described above, as the heel of the boot descends under pressure from the heel of the skater, push rod 24 moves forward. The push rod 24 pushes an actuating rod 35, which via pins 34 and brake pad mounts 32 pushes the brake pads 30 to bear against brake drums 41. The brake mounts 32 are constrained on the end opposite the actuating rod 35 by pins 33, which run through side walls 16L and 16R and through apertures 31, allowing the brake mounts 32 to rotate freely around pins 33. Brake pads 30 are held firmly in place by mounts 32. Thus when the skater rocks the boot of the skate backward, the pressure on the heel of the boot is translated into pressure on the brake pads 30, which provides rolling resistance via drums 41 and tires 42. The movement forward of the brake pads 30 is a fraction of the movement downward of the heel, providing leverage so pressure exerted on the actuating rod 35 is much greater than the heel pressure exerted by the skater. The amount of braking can be effectively modulated by modulating the pressure applied to the heel of the skate. Thus the skater is able to affect braking force with much greater ease than in the heel drag prior art, which offers no leverage. This fact is an important differentiate between the invention and the prior art.

The forwardmost wheel is mounted slightly higher than the others to simulate the turning action of ice skates, as in conventional designs. Thus when braking action is achieved, this wheel will not normally be touching the ground, and needs no brake. It is understood that a brake could easily be added to the forwardmost wheel if it were mounted at the same height as the others.

When the skater assumes a normal position on his or her feet, the boot 62 rocks forward, taking the pressure off the push rod 24 and allowing the brake pads 30 to clear the brake drums 41. The spring 22 assists the boot 62's return to its normal position and removes the sensation of loose motion that would otherwise exist when the skate is suspended in mid-air.

Figure 12:
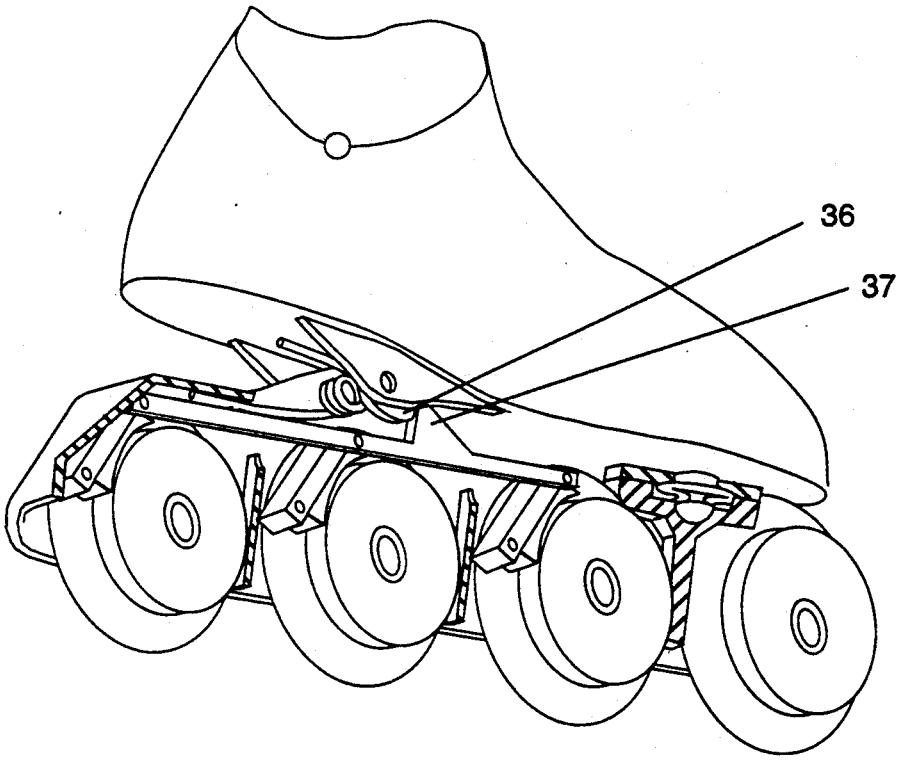
FIG. 12 is a perspective view partially in section of an alternate embodiment of the actuating linkage of the present invention.

The embodiment described by FIGS. 3, 4, 7, 8, 9, 10, and 11 is not the only means to achieve the leverage desired for smooth and effective braking. FIG. 12 depicts an embodiment that utilizes a cam 36 and follower 37 to accomplish the same purpose. As the boot 62 rotates, it rotates the cam 36. As the cam 36 rotates it imposes a greater length against the follower 37, pushing it forward. The follower is firmly attached to the actuating rod 35 and so pushes it forward, pulling and pushing the brake mounts 32 forward which actuate the braking action via brake pads 30. The outline of the cam 36 is shaped such that the difference between the cam follower 37 and the shaft 23 is only slightly greater when the boot 62 is rotated than when it is not, thereby achieving the desired leverage.

Figure 13:
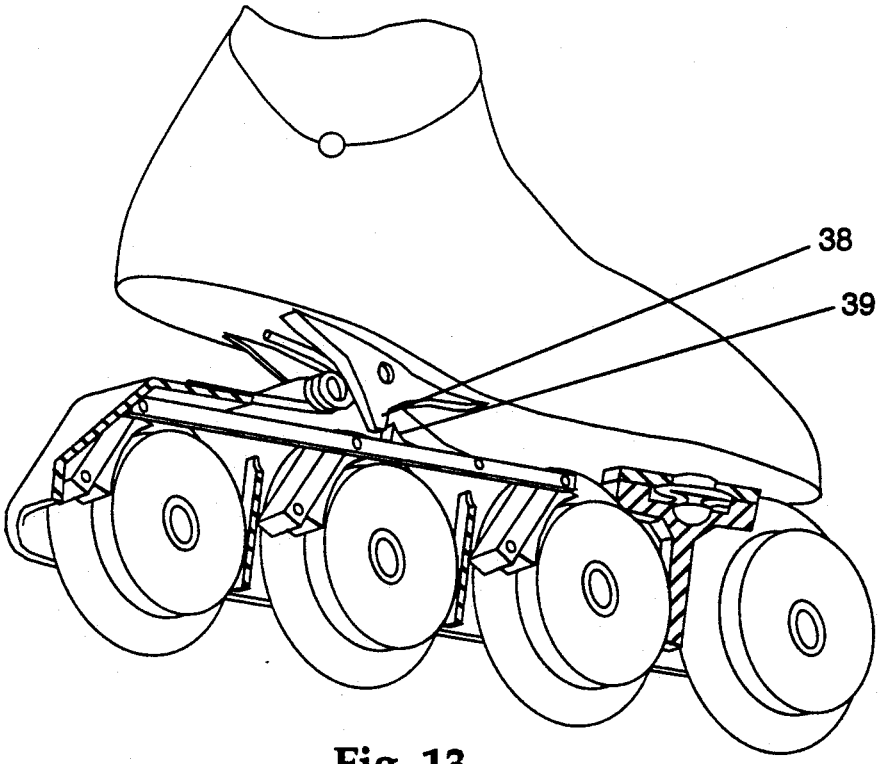
FIG. 13 is a perspective view partially in section of another alternate embodiment of the actuating linkage of the present invention.

FIG. 13 depicts yet another embodiment to accomplish the same purpose. This embodiment includes a dog 38 which is firmly affixed to the underside of the boot 62, and a dog follower 39 which is firmly attached to actuating rod 35. As the boot rotates, the dog 38 moves forward, pushing dog follower 39 forward and actuating the brake in a similar fashion as the two embodiments already described. Because the distance between the heel of the boot 62 and the shaft 23 is considerably greater than the distance between the intersection of dog 38 and dog follower 39 and the shaft 23, leverage is again achieved.

Figure 5:
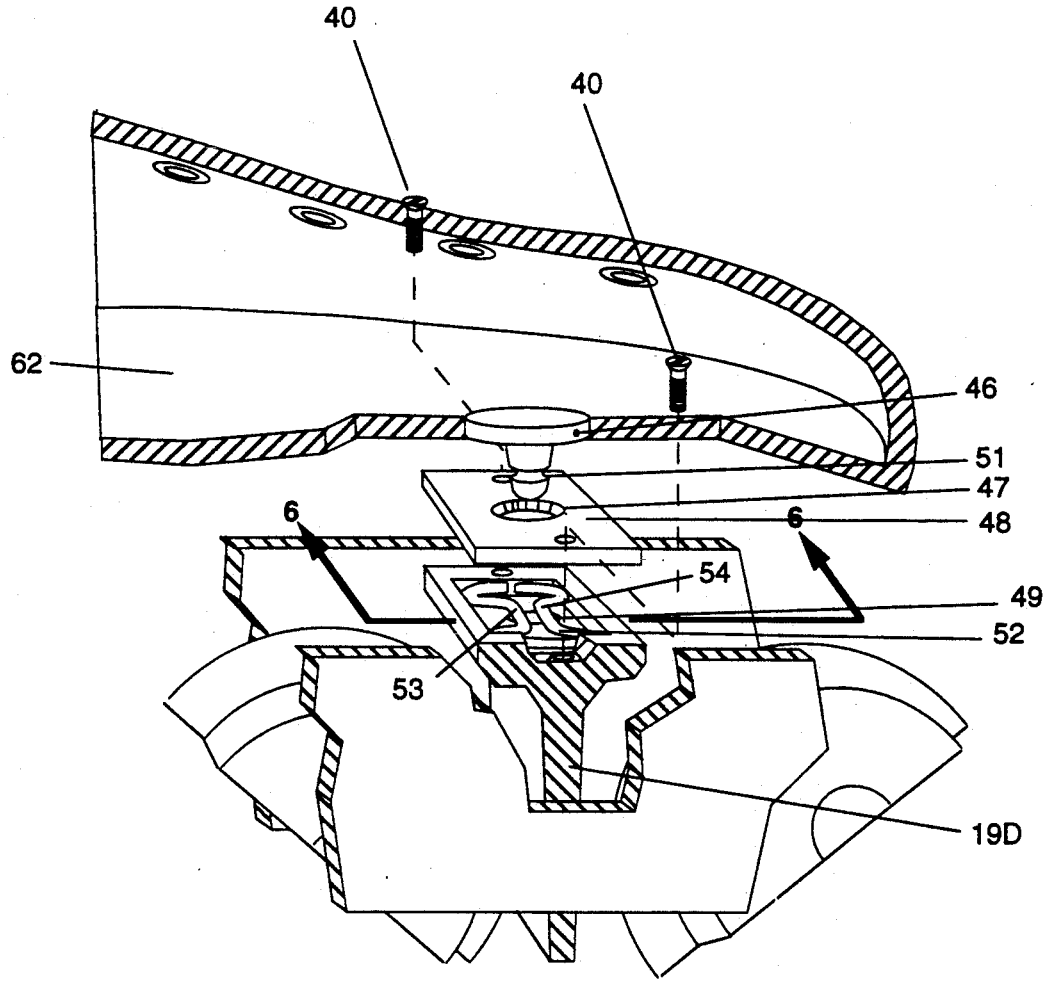
FIG. 5 is an exploded and partial sectional detail of a subassembly of the present invention.
Figure 6:
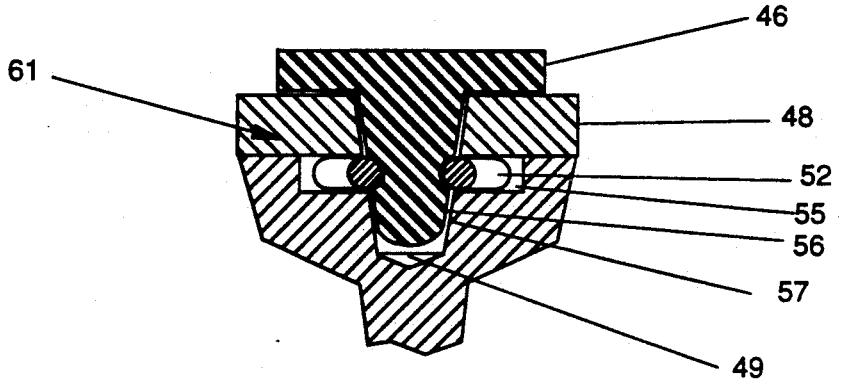
FIG. 6 is a partial sectional view of the subassembly of FIG. 5 along the lines 6—6 of FIG. 5.

Referring to FIGS. 5 and 6, a plunger 46 is imbedded in the underside of boot 62. The plunger includes a circumferential groove 51.

The frame 15 includes a web 19D whose cross-section is larger toward the top than at the bottom. The top of web 19D includes a channel 55 which in turn contains an tapered aperture 49. A clip 52 made from spring steel or similar material lies in the channel 55 and is contained by plate 48. Plate 48 is attached to web 19D by two or more screws 40, and when attached lies flush with the top of frame 15.

When the boot is returned to its normal position, the plunger 46 passes through a tapered aperture 47 in plate 48, and then into a second tapered aperture 49, located in the top surface of web 19D. The plunger 46 incorporates a circumferential groove 51 which engages a clip 52 when the boot 62 arrives at is resting position, defined when the underside of the boot 62 encounters the top of frame 15. The clip 52 is fashioned in such a way that its two arms 53 and 54 are forced apart as the wider portion of plunger 46 passes through clip 52, and are allowed to return closer together, but not to their original, resting position, when the groove 51 and the clip 52 are adjacent to one another. Consequently when the boot comes to rest, the clip 52 exerts a constant pressure on the plunger 46, specifically on the area of the groove 51, so that the plunger 46 resists being pulled out of the clip 52 and subsequently out of the whole assembly. The operative result is that the skater must momentarily exert extra force to the heel of the boot 62 in order to disengage the boot 62 and plunger 46 from the detent assembly 61 and begin braking. This extra force prevents inadvertent actuation of the brake when the skater departs temporarily from the usual balanced position.

At the same time that the groove 51 contacts the clip 52, the exterior surface 56 of the plunger meets the inner surface 57 of the tapered aperture 49, which prevents movement of the plunger 46, and therefore of the boot 62, in either downward or sideways directions. Both these surfaces are conical, ensuring that the plunger 46 may enter the aperture 49 cleanly in spite of the arcing motion the plunger 46 takes while descending into the aperture 49. The contact between plunger surface 56 and tapered aperture surface 57 serves to make the boot 62 and the frame 15 feel like a conventional, rigid, skate.

With extended use the brake pads 30 will wear down to the point where the boot 62 can rock backward until it contacts the rear of the frame 15 without pushing the push rod 24 forward enough to cause the brake pads 30 to contact the drums 41. To remedy this situation the skater turns the thumbwheel 14, causing the threaded rod 13 to advance away from the block 63. This decreases the rotation required of the boot 62 in order to establish contact between the brake pads 30 and the brake drums 41, effectively compensating for brake pad wear. This may also be use to tune the brakes to the individual's liking, either for immediate or slightly delayed braking action after the boot 62 and plunger 46 are broken out of the detent assembly 61.

I claim:

1. A roller skate brake comprising:

a) a boot including:
  a flange with holding means for rotatably holding a shaft, b) a frame including:
  flange means with holding means for rotatably holding said shaft of said boot flange and for movably mounting said boot to said frame,
  sidewalls on said frame adapted to mount a plurality of axles, c) a wheel mounted to each of said plurality of axles, said wheel mounted on said axles being in a common plane a plurality of said wheels including a braking drum, d) a brake assembly consisting of:
  a brake mount, and
  a brake pad secured to said brake mount and adapted to cooperate with said braking drum, e) an actuating rod constrained to move in a single plane and primarily in a forward and rearward direction relative to said frame, f) and a first connecting means between said boot and said actuating rod and a second connecting means between said actuating rod and said brake mount such that movement of a portion of said boot relative to said frame about said movable mounting causes a force to be exerted on said brake mount through said actuating rod to engage said brake pad with said braking drum.

2. The roller skate brake of claim 1 wherein said holding means for rotatably holding said shaft of said boot flange and for rotatably mounting said boot to said frame is a hinge connection of said boot to said frame, whereby said movement of said portion of said boot about said hinge connection causes movement of said brake pad with respect to said brake drum.

3. The roller skate brake of claim 1 wherein said first connecting means between said boot and said actuating rod includes a leverage mechanism that converts movement of said boot to engagement of said brake pads with said brake drum.

4. The roller skate brake of claim 1 including a releasable detent connection means between said boot and said frame whereby said brake assembly is maintained inoperative until said detent connection is selectively released.

5. The roller skate brake of claim 1 wherein said brake assembly includes a brake pad cooperationg with a brake drum on a plurality of said wheels and said force exerted on said actuating rod causes brake pad and brake drum engagement on said plurality of said wheels.

6. The roller skate brake of claim 1 including means on said first connecting means between said boot and said actuating rod for adjusting an effective length of said first connecting means to compensate for wear of said brake pads.

7. The roller skate brake of claim 6 wherein said means for adjusting an effective length of said first connecting means is a rotatable thumbscrew.

* * * * *